United States Patent [19]

Milosh et al.

[11] Patent Number: 4,480,666

[45] Date of Patent: Nov. 6, 1984

[54] MATERIAL SPLITTER

[75] Inventors: Michael D. Milosh; Robert J. Geoghegan, both of Columbus, Ohio

[73] Assignee: Battelle Memorial Institute, Columbus, Ohio

[21] Appl. No.: 484,145

[22] Filed: Apr. 11, 1983

[51] Int. Cl.[3] ..... B27L 7/00

[52] U.S. Cl. ..... 144/194; 144/366

[58] Field of Search ..... 144/193 R, 194, 366

[56] References Cited

U.S. PATENT DOCUMENTS 4,252,166 2/1981 Kozicki ..... 144/194

4,403,635 9/1983 York ..... 144/194

FOREIGN PATENT DOCUMENTS 2814249 7/1979 Fed. Rep. of Germany ..... 144/194

2073656 10/1981 United Kingdom ..... 144/194

*Primary Examiner*—W. D. Bray

*Attorney, Agent, or Firm*—Robert B. Watkins

[57] ABSTRACT

An apparatus for splitting materials including wood, having rotating conical wedge elements which screw their way into the material thereby splitting and/or fracturing the material. The axes of rotation of the conical wedge members are closer together at the pointed ends than at the base ends, and in a preferred embodiment are touching at the pointed ends with the surfaces of the conical wedge members in contact along their lengths.

10 Claims, 5 Drawing Figures

FIG. 1
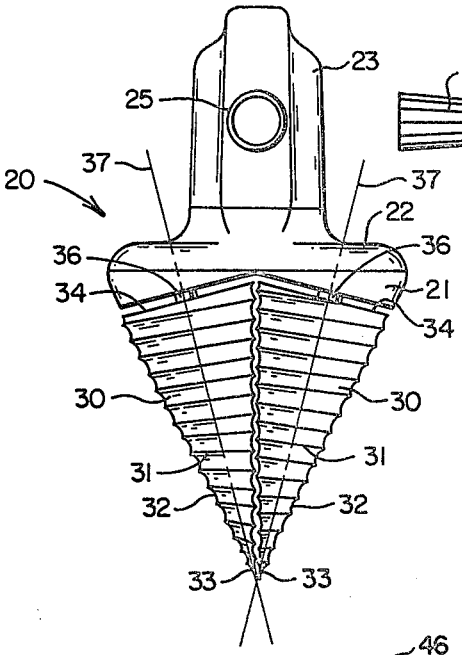
FIG. 2
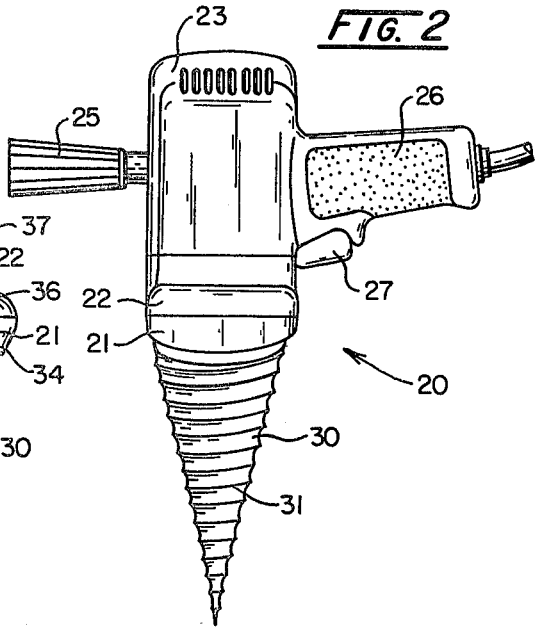
FIG. 3
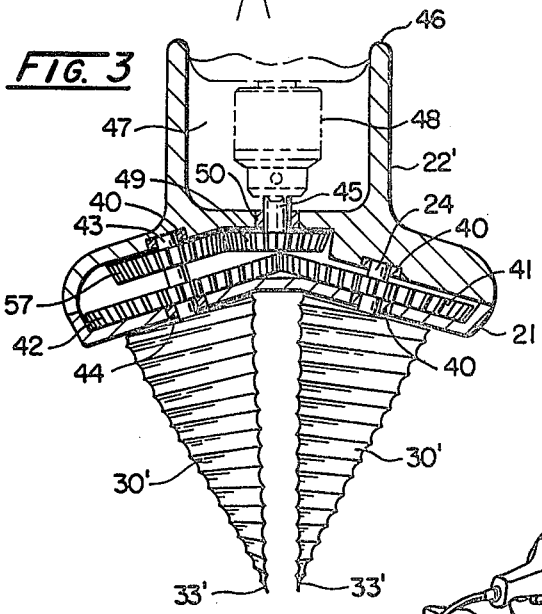
FIG. 4
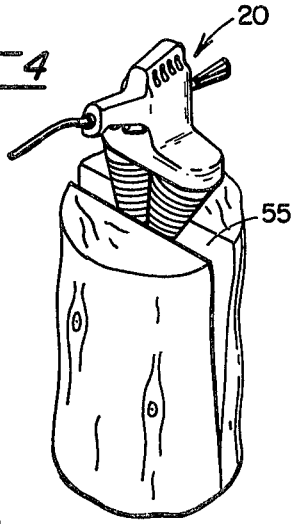
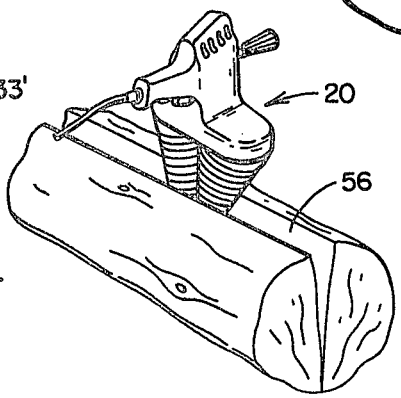
FIG. 5

MATERIAL SPLITTER

BACKGROUND OF THE INVENTION

This invention relates to an apparatus for splitting, cracking, or fracturing materials by wedging a pointed tool into the material. More particularly, it relates to an apparatus for simultaneously screwing two or more conical wedges into the material to create fracturing or splitting.

Historically, the most common method of splitting a material is by forcing a wedge between the fibers of the material in a plane parallel to the longitudinal axis of the fibers by which the wedge forces the fibers to give up their internal tensions. This invention employs the wedge concept in a conical arrangement.

Whether the wedge is planar in the form of flat surfaces coming together in an edge, such as an ax, or the wedge is a conical screw, the splitting action remains the same. A wedge is forced or driven deeper into the material creating lateral forces that overcome the lateral forces between the fibers of the material releasing their hold on adjacent fibers, so that the material "splits".

In the discussion preceding and following, the workpiece is described with various terminology. In the preferred embodiment the workpiece is wood material, such as logs. However, it should be understood that the operational principles of the apparatus of this invention may be applicable to other materials, particularly if they are fiberous and of a nature similar to wood. In some instances, the apparatus of this invention could be directed to less fiberous and more homogeneous materials such as ceramics and plastics, etc.

In the earliest of times and even in recent years the hand or power ax remains the most common-place type of wood splitting device. However, with the development of more compact rotational power sources the use of rotary conical screw-type wedges have been introduced at least conceptually, if not in extensive practice.

In the conical wedge-type, the progressive driving force carrying the wedge deeper into the material is a helical thread; i.e., a screw progressing deeper as it is rotated.

Typical devices employing single screw helical wedge members are illustrated in the following U.S. Pat. Nos. 953,162—Weinberg, 1,319,656—Merwin, 3,670,789—Thackery, 4,026,337—Thackery, 4,027,709—Thackery.

These single screw devices have the obvious disadvantage that means must be provided to prevent the log material from rotating when the screw is rotated into the material. Various means have been devised to either grasp the log or bar its rotation, but the forces involved are substantial so that the holding means must be substantial also.

More recently, multiple screw devices have been proposed and patented, as disclosed in U.S. Pat. No. 4,252,166—Kozicki and German Patent No. DT2814-249—Hamm.

The Kozicki device discloses a relatively portable construction in which two counter rotating helical screw wedge members are presented to and are driven into the material on parallel rotational axes.

The patent to Hamm is similar except that it relates more specifically to a tractor draw bar or power takeoff type device for mounting on the rear of the conventional vehicle type tractor.

SUMMARY OF THE INVENTION

This invention is an apparatus for splitting wood and other similar materials comprising: a plurality of conical threaded wedge members, arranged for rotation on separate axes, the wedge members being conical in shape, rotatable about their longitudinal axes, and being positioned on the axes of rotation with the axes passing through the conical point of the wedge members; with each wedge member having a conically threaded surface; the rotational axis of each conical member being arranged relative to each other with the axes of the conical members being closer together at the conical points than the axes passing through the base of the conical members; and the conical members being supported in rotation by a frame and driven in rotation by a power means connected to the conical wedge members.

In the prior art multiple screw devices, the tendency is obviated for the work piece of wood, log, or material to rotate with the screw as above described for the single screw units. Also with counter rotating screws in parallel axis position making simultaneous progress into the material, the forces of rotation generated by one screw are offset by substantially equal and opposite rotational forces in the opposite direction produced by the other screw.

However, it has been found that progress of the screws is impeded by the collection of compressed material between the screws. As the screws rotate counter to each other and the helix on the threads moves the material progressively toward the base of the conical screws, packed wood material builds up between the screws, in some instances toward the point that the apparatus would jam and the torque required would be greater than the capacity of the power supply apparatus.

Another serious problem in parallel axes multiple screw devices is the build up of lateral forces between the cones, applying movements on the shafts supporting the screws. Since the cones are cantilevered from the positions where the shafts are supported, the lateral forces tend to bend the shafts, creating serious problems in the shaft supports and drive train for the screws.

The applicants have conceived and determined that these problems are overcome when the axes of rotation of the adjacent screws are not parallel, and the points of adjacent conical screws, through which the axis of rotation passes, are closer together at the pointed end of the cones, relative to the axes passing through the centers of the base ends of the cones. This improvement, comprising arranging the axis of rotation with closer position at the pointed ends, may be provided in varying degrees. An optimum arrangement can be achieved when the points of adjacent cones are closely adjacent or touching, and the helices of adjacent cones are closely adjacent or in rolling contact.

With this optimum arrangement of the improvement of this invention, the forces and problems connected with the powering and operation of the device are substantially reduced. Also with this substantial improvement in performance, it is practical to construct a relatively portable "hand tool" type of apparatus since all the rotational forces are balanced and the splitting helical wedge members draw themselves into the wood material without substantial support or guidance on the part of the operator.

It is an object of this invention to provide a wood material splitting device that is relatively portable, easy to operate, compact in size, and comparatively inexpensive to manufacture.

Other objects and features of the invention will be apparent and understood from the detailed description of the invention and the accompanying drawings which follow.

DESCRIPTION OF THE DRAWINGS

FIG. 1 is a front elevational view of the apparatus of this invention.

FIG. 2 is a side elevational view of the apparatus of this invention.

FIG. 3 is a front partially sectional elevational view showing a portion of the internal construction, and another typical embodiment of this invention.

FIG. 4 is a perspective view of the apparatus of this invention splitting the end of a log segment during the operational procedure of this invention.

FIG. 5 is an elevational perspective view of the apparatus of this invention in a typical operational position splitting a log longitudinally.

DETAILED DESCRIPTION OF THE INVENTION

Referring to FIGS. 1 and 2, a wood splitter apparatus 20 comprises a frame 21 connected to a housing 22. The housing 22 is formed in its upper section 23 generally in a shape to house a power source means, such as an electric motor (not shown). The housing 22 is formed to include a handle 25 and a grip 26. The grip includes a switch 27.

The frame 21 supports a pair of conical wedge members 30 having helical screw threads 31 formed on their outer surface 32 between a pointed end 33 and a base end 34. Each conical wedge member 30 is arranged and mounted for rotation on a rotational support means such as a shaft 36 about an axis 37.

Preferably, the conical wedge members 30 are symmetrically positioned on the axes of rotation and have uniformly increasing larger diameter helical threads.

By conventional means, to be later described with respect to FIG. 3, conical wedge members 30 are driven in rotation through shafts 36 by the power means.

In the preferred embodiment shown in FIGS. 1 and 2, the pointed ends 33 of the conical wedge members 30 are in adjacent or touching position and the axes 37 substantially intersect at their pointed ends 33. The helical threads 31 of the adjacent wedge members 30 are developed in opposite directions of matching pitch and contour so that the threads 31 mesh as the members 30 are rotated in opposite directions. By this means, the surfaces of the conical wedge members 30 are in contact and roll upon each other during operation of the apparatus 20.

Referring to FIG. 3, the frame 21 and housing 22' are shown in cross-section. Conical wedge members 30' are rotatively supported on shafts 24' and 43 to rotate on essentially inflexible axes, typically carried in bushings 40. By "essentially inflexible" it is meant that shafts and axes remain essentially free of deviation from straight during operation.

The shaft 24' is fitted and keyed in a miter gear 41 which meshes with another common miter gear 42 that is rotationally supported and keyed to a shaft 43.

As shown in FIG. 3, housing 22' terminates at an end 46 to form a receptacle 47 constructed to receive a chuck 48 (shown in phantom) and motor housing 49 (shown in phantom) of a conventional portable electric hand drill that may be inserted in the receptacle 47 to grip a shaft 45. The shaft 45 is connected to a miter gear 49 and rotates in a bushing 50 which meshes with another miter gear 51 that is fitted and keyed to shaft 43.

As a result of the gearing shown in FIG. 3, the conical wedge members 30' rotate in opposite directions when driven by a power source means such as an electric motor. The gear arrangement shown in FIG. 3 is typical of the type of power train which could be used to cause the conical wedge members 30 or 30' to rotate, and the helical threads 31 thereon, to "screw" into a material on which they are brought into contact. Other conventional drive means may be provided by those having skill in the art and need not be described in further detail. A drive train with universal joints may simplify the arrangement.

In the operation of splitting workpiece materials, such as logs, an operator (not shown) grasps the handle 25 and grip 26, with a finger on the switch 27. The points 33 are positioned against the end of a log 55, referring to FIG. 4, or the side of a log 56, referring to FIG. 5, thereby placing the apparatus 20 in position to commence. The plane of the axes 37 is oriented generally parallel to the longitudinal axis of the fibers of the material and the switch is operated to cause the conical wedge members 30 to rotate. The threaded surfaces of the members 30 screw into the wood in cooperative concert to pull the members 30 into the wood creating wedging forces that split the wood. Because the conical wedge members 30 are rotating on axes which are tapered toward a generally closer point of application; i.e., the axis are closer together at the pointed ends than they are at the base ends, the members 30 act in concert and cooperate with each other enhancing the effect and avoiding the collection and compacting of materials between the members 30. This beneficial effect takes place to a greater degree as the axis at the points are arranged closer together. The optimum results are achieved in the preferred embodiment shown in FIGS. 1 and 2 in which the points of the members 30 are adjacent or in contact, surfaces of the members 30 mesh, and pull upon each other.

Referring to the embodiment shown in FIG. 3, the pointed ends 33' of the conical wedge members 30' are arranged in relatively close proximity to one another. In addition, the helical conical surfaces of the wedge members 30' do not touch nor are they in rolling contact. In this embodiment, the rotational axis of the conical members are arranged relative to each other with the axes of the conical members being closer together at the conical points than the axes passing through the bases of the conical members. The operation of this embodiment would be expected to provide an improvement in operations in comparison to prior art arrangements where the axes of the conical wedge members are parallel. The embodiment of FIG. 3 employes the advantageous concepts of this invention in an improved degree but is not expected to provide the same optimum operating characteristics as those which have been found to exist in the arrangement shown in FIGS. 1 and 2.

In the embodiment of FIG. 3, the shafts may be arranged to rotate in the same direction, since the cones do not touch or roll on each other. The conventional drive means and/or power train required may be further simplified in such an arrangement. Each cone could be exactly the same as others which would simplify and reduce the cost of manufacturing processes.

It has been found that in the operation of an apparatus, as shown in FIG. 1, the conical wedge members 30 pull or screw themselves into the material without noticeable twist or torque on the frame or other reactive forces on the handle 25 or grip 26.

In a demonstration apparatus constructed according to the arrangement of FIGS. 1 and 2, having two conical wedge members with a diameter of 2.5 inches (7.5 cm) at the base, and a length of 9.4 inches (23.9 cm) from pointed end to the base end provided, with conical threads of an average pitch of 6 per inch (2.4 per cm) with an average depth of thread of 0.14 inch (0.37 cm), it was found that logs could be split according to the following table without jamming, binding, or shaft bending:

TABLE I

| LOG SPECIES | LOG DIAMETER | LOG LENGTH | LOG CONDITION | TYPE OF SPLIT | TORQUE REQUIREMENT |
|---|---|---|---|---|---|
| White Ash | 12" | 19" | Dry | Side | 200 Ft-Lbs |
| Pin Oak | 9" | 20" | Wet | Side | 100 Ft-Lbs |
| White Ash | 12" | 21½" | Dry | Side | 340 Ft-Lbs |
| Elm | 9½" | 20" | Wet, Soft | End | 154 Ft-Lbs |
| Hard Maple | 15" | 11½" | Dry, Dead | End | 406 Ft-Lbs |
| Hard Maple | 13' | 10" | Dry, Dead End | 154 Ft-Lbs | |
| White Ash | 14" | 19" | Green, New | End | 175 Ft-Lbs |
| Elm | 9" | 14" | Wet | End | 119 Ft-Lbs |

It is believed that lubrication of the surfaces of the cones will further enhance the operation of the apparatus.

In a further similar experiment with axes of the conical wedge members arranged in parallel spaced relation, it was found that jamming, binding, or shaft bending occurred.

Throughout the above descriptions, the use of two conical wedge members is described and discussed as most convenient for the practice of this invention. In some circumstances, more than two conical wedge members could be used to advantage to provide more severe wedging action.

Although the power source of the invention has been described as an electric motor, other power sources could be used, such as a gasoline motor, an air motor, or a power takeoff from a vehicle supported power source. The power source may be reversible so that the cones can be "backed out" of the material, if necessary.

It is herein understood that although the present invention has been specifically disclosed with the preferred embodiments and examples, modification and variations of the concepts herein disclosed may be resorted to by those skilled in the art. Such modifications and variations are considered to be within the scope of the invention and the appended claims.

We claim:

1. An apparatus for forcibly splitting material including wood comprising:

a. a plurality of conical and threaded wedge members having a base and a point, said wedge members being mounted on separate longitudinal rotational axes, the wedge members being rotatable about their said longitudinal axes, with said axes passing through the conical point of each said wedge members and through the center of the base of each said wedge member;

b. each wedge member having a conically threaded surface;

c. the rotational axes of the conical members being mounted by essentially inflexible support means relative to each other with said longitudinal axes of the conical members closer together at the conical points than the said longitudinal axes passing through the bases of the conical members; and d. the conical members being mounted for rotation on a frame means and driven in rotation by power means connected to the conical wedge members.

2. An apparatus according to claim 1 wherein each conical wedge member has a symmetrical position on the axis of rotation.

3. An apparatus according to claim 1 wherein each wedge member has a conically threaded surface of uniformly increasing larger diameter helical threads.

4. An apparatus according to claim 1 wherein each conical wedge member is driven in rotation in the opposite direction from the adjacent conical wedge member.

5. An apparatus according to claim 1 wherein the surfaces of adjacent cones are generally parallel relative to each other.

6. An apparatus according to claim 1 wherein the axis of rotation of the conical wedge members intersect at the points of adjacent members, the angle between the intersecting axis is arranged for the helically threaded surfaces of the conical members to roll upon the adjacent conical wedge member and the helically wedge surfaces of the conical wedge members are sized and proportioned for matching threaded engagement during rotation of the conical wedge members.

7. An apparatus according to claim 1 wherein the power means is an electric motor.

8. An apparatus according to claim 7 wherein the electric motor is mounted on the frame.

9. An apparatus according to claim 8 wherein the frame includes a housing for the motor and the housing is provided with at least one handle for the operator to support and aim the points of the conical wedge members into the material.

10. An apparatus according to claim 1 wherein the power means is connected to the conical wedge members, but is not supported by the frame of the apparatus.

* * * * *